US006454096B1

(12) United States Patent
Kondoh et al.

(10) Patent No.: US 6,454,096 B1
(45) Date of Patent: Sep. 24, 2002

(54) PACKAGE FOR DISPENSING INDIVIDUAL SHEETS

(75) Inventors: Kazunori Kondoh; Hiroto H. Katagiri, both of Tokyo (JP); Gene H. Shipman, St. Paul; Alan J. Sipinen, North Oaks, both of MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/585,649

(22) Filed: Jun. 1, 2000

(51) Int. Cl.[7] ..... B65D 73/00

(52) U.S. Cl. ..... 206/494; 206/804; 206/813

(58) Field of Search ..... 206/494, 449, 206/804, 812, 813; 428/40.1, 41.7, 41.8, 42.2, 42.3; D6/518, 519; 221/22, 33, 45, 286; 383/210, 211, 38, 39

(56) References Cited

U.S. PATENT DOCUMENTS

| | | | | |
|---|---|---|---|---|
| 1,205,892 A | | 11/1916 | Hecht | |
| 2,032,150 A | | 2/1936 | Richardson | |
| 2,046,975 A | * | 7/1936 | Shaw et al. | 383/210 |
| 2,071,981 A | | 2/1937 | Landsiedel | |
| 2,269,525 A | | 1/1942 | Fleischer | |
| 2,287,420 A | * | 6/1942 | Edmonston | 206/804 |
| 2,341,794 A | | 2/1944 | Kliwer | |
| 2,885,112 A | | 5/1959 | Willat | |
| 3,509,991 A | * | 5/1970 | Hurst | 206/813 |
| 3,825,379 A | | 7/1974 | Lohkamp et al. | |
| 3,971,373 A | | 7/1976 | Braun | |
| 4,192,420 A | * | 3/1980 | Worrell, Sr. et al. | 206/205 |
| 4,532,937 A | | 8/1985 | Miller | |
| 4,574,952 A | | 3/1986 | Masui et al. | |

(List continued on next page.)

FOREIGN PATENT DOCUMENTS

| | | | |
|---|---|---|---|
| EP | 0 821 153 B1 | | 1/1998 |
| GB | 2061709 | | 5/1981 |
| JP | 56-8606 | | 1/1981 |
| JP | 58-74894 | | 5/1983 |
| JP | 4-045591 | | 2/1992 |
| JP | 5-18392 | | 1/1993 |
| JP | H06-25277 | | 4/1994 |
| JP | 6-319664 | | 11/1994 |
| JP | H10-15304 | | 1/1998 |
| WO | WO-96/17794 | * | 6/1996 |
| WO | WO 99/29220 | | 6/1999 |

OTHER PUBLICATIONS

U.S. patent application Ser. No. 09/566,308.

Wente Van A., "Superfine Thermoplastic Fibers", *Industrial Engineering Chemistry*, vol. 48, p. 1342 et seq. (1956).

Wente et al., "Manufacture of Superfine Organic Fibers", Report No. 4364 of the Naval Research Laboratories, published May 25, 1954.

U.S. patent application Ser. No. 09/566,308 (3M Ref: 54943USA2A.002 ).

U.S. patent application Ser. No. 09/780,094 (3M ref: 56167USA6A..002).

U.S. patent application Ser. No. 09/582,838 (3M Ref: 53859USA2.008).

*Primary Examiner*—Shian Luong
(74) *Attorney, Agent, or Firm*—Gary L. Griswold; Robert W. Sprague; William J. Bond

(57) ABSTRACT

A package for dispensing individual oil absorbing polymeric sheets from a stack of such sheets, where the package includes a cover flap repeatedly moveable between an open position and a closed position, a pocket, a plurality of oil absorbing polymeric sheets arranged in a stack and positioned in the pocket, and a pressure-sensitive adhesive composition disposed on the cover flap such that closing the cover flap positions the pressure-sensitive adhesive composition for contact with a major surface of the first sheet of the stack of sheets.

28 Claims, 6 Drawing Sheets

U.S. PATENT DOCUMENTS 4,643,939 A 2/1987 Sugiyama et al.
4,645,077 A * 2/1987 McLaughlin et al. ..... 206/449
4,650,706 A * 3/1987 Emmel ..... 428/40.1
4,726,989 A 2/1988 Mrozinski
4,739,902 A 4/1988 Joslyn et al.
4,755,178 A 7/1988 Insley et al.
4,818,463 A 4/1989 Buehning
4,907,174 A 3/1990 Priem
4,979,613 A * 12/1990 McLaughlin et al. ..... 206/223
4,986,743 A 1/1991 Buehning
5,044,776 A * 9/1991 Schramer et al. ..... 383/39
5,046,640 A 9/1991 Carroll
5,119,828 A 6/1992 Miller
5,144,744 A 9/1992 Campagnoli
5,178,269 A * 1/1993 Evers ..... 206/813
5,184,725 A 2/1993 Reinheimer et al.
5,242,057 A * 9/1993 Cook et al. ..... 206/581
H1363 H * 10/1994 Leeker ..... 206/440
5,560,484 A * 10/1996 Tomisawa et al. ..... 206/387.1
5,569,230 A * 10/1996 Fisher et al. ..... 604/385.1
5,647,506 A * 7/1997 Julius ..... 206/449
5,935,521 A 8/1999 Khazaka
6,026,873 A * 2/2000 Van Geer ..... 150/147

* cited by examiner

PACKAGE FOR DISPENSING INDIVIDUAL SHEETS

BACKGROUND

The invention relates to dispensing individual sheets from a package, and to dispensing individual oil absorbing polymeric sheets from a package.

Oil continuously forms on the face of an individual, particularly the nose, cheek, forehead and chin. A variety of products have been developed to remove skin oil (i.e., sebum) from the face. Dry methods of removing these facial oils include the use of oil absorbent wipes.

The wipes are often nonwoven webs that are thin, conformable and non-abrasive. Paper type wipes have also been used to remove facial oil. These paper type wipes often include natural or synthetic papers using vegetable fibers, synthetic pulp or kenaf. These oil absorbent papers are generally irritating to the skin due to the hard and stiff nature of the fibers. Other oil absorbent wiping products are available in the form of thin polymeric sheets.

Thin sheets, e.g., paper, are often packaged in the form of a stack. Removing a single sheet of a thin, pliable material from a stack of such sheets can be difficult because the sheets tend to stick together or to the support on which they are provided. Polymeric sheets, for example, tend to be difficult to separate due to static attraction between the sheets and the smooth surfaces of the sheets. The edges of a stack of polymeric sheets also may weld together when the stack is cut, e.g., to form an individual smaller stack from a larger stack, which can further inhibit removal. The difficultly in grasping an individual sheet can also result in damage, e.g., marring, creasing, or soiling, to the sheet.

SUMMARY

In one aspect, the invention features a package that is capable of repeatedly dispensing individual oil absorbing polymeric sheets from a stack of such sheets.

In other aspects, the invention features a package for dispensing individual oil absorbing polymeric sheets from a stack of the sheets where the package includes a cover flap repeatedly moveable between an open position and a closed position, a pocket, a plurality of oil absorbing polymeric sheets arranged in a stack and positioned in the pocket, and a pressure-sensitive adhesive composition disposed on the cover flap such that closing the cover flap positions the pressure-sensitive adhesive composition for contact with a major surface of the first sheet of the stack of sheets. In one embodiment, the pressure-sensitive adhesive composition is disposed on the cover flap such that pressing the pressure-sensitive adhesive composition against the first sheet bonds the first sheet to the cover flap through the pressure-sensitive adhesive composition, and moving the cover flap to an open position frees the first sheet from the pocket. In another embodiment, the bottom wall further includes a depressible hinged tab. In other embodiments, the package further includes a rigid insert disposed in the pocket.

In some embodiments, the adhesive composition is in the form of an adhesive tape construction that includes a plurality of pressure-sensitive adhesive layers. In another embodiment, the pressure-sensitive adhesive composition is in the form of an adhesive tape construction that includes a) a plurality of adhesive tape structures that include 1) a backing, 2) a first pressure-sensitive adhesive composition disposed on a first surface of the backing, and 3) a second adhesive composition disposed on a second surface of the backing, and b) a polymeric film disposed between the structures and being removable from at least one of the structures. In one embodiment, the pressure-sensitive adhesive composition includes an acrylate.

In other embodiments, the pressure-sensitive adhesive composition is positioned to contact at least a portion of the center of the first sheet. In another embodiment, the package further includes a second pocket.

In one embodiment, the pocket includes a bottom wall and a top wall extending from the bottom wall. In some embodiments, the pocket includes a bottom wall, a top wall generally parallel to the bottom wall, and a side wall disposed between and generally perpendicular to the top wall and the bottom wall. In another embodiment, the pocket includes a bottom wall that defines a shape selected from the group consisting of rectangle, square, triangle, circle, and ellipse.

In another aspect, the invention features a package for dispensing individual sheets from a plurality of sheets arranged in a stack where the package includes a) a cover flap moveable between an open position and a closed position, b) a pocket dimensioned to store a plurality of sheets arranged in a stack, the pocket including a top wall defining an opening through which a major surface of a first sheet of stored stack of sheets is exposed and a bottom wall that includes a depressible hinged tab, and c) a pressure-sensitive adhesive composition disposed on a surface of the cover flap such that closing the cover flap positions the pressure-sensitive adhesive composition for contact with the exposed major surface of the first sheet. In one embodiment, the pressure-sensitive adhesive composition is disposed on the cover flap such that pressing the pressure-sensitive adhesive composition against the first sheet bonds the first sheet to the cover flap through the pressure-sensitive adhesive composition, and moving the cover flap to an open position frees the first sheet from the pocket. In some embodiments, the package further includes a plurality of sheets arranged in a stack. In one embodiment, the package further includes a rigid insert disposed in the pocket.

In some embodiments, the pressure-sensitive adhesive composition is selected from the group consisting of acrylate-, rubber-, polyurethane- and silicone-based pressure-sensitive adhesive compositions, and combinations thereof. In other embodiments, the pressure-sensitive adhesive composition is positioned to contact at least a portion of the center of the first sheet.

In other aspects, the invention features a package for dispensing individual sheets from a plurality of sheets arranged in a stack, the package that includes a) a cover flap repeatedly moveable between an open position and a closed position, b) a pocket dimensioned to store a plurality of sheets arranged in a stack, the pocket includes a bottom wall, and a top wall generally parallel to the bottom wall and having a continuous perimeter that defines at least 50% of an opening through which a major surface of a first sheet of a stored stack of sheets is exposed, and c) a pressure-sensitive adhesive composition disposed on a surface of the cover flap such that closing the cover flap positions the pressure-sensitive adhesive composition for contact with the exposed major surface of the first sheet. In some embodiments, the bottom wall includes a depressible hinged tab.

In one aspect, the invention features, a package for dispensing individual sheets from a plurality of sheets arranged in a stack, the package including a cover flap repeatedly moveable between an open position and a closed position, a pocket, a plurality of sheets arranged in a stack and positioned in the pocket, a rigid insert, and a pressure-sensitive adhesive composition disposed on the cover flap such that closing the cover flap positions the pressure-sensitive adhesive composition for contact with the exposed major surface of the first sheet.

In some aspects, the invention features a package for dispensing individual sheets from a stack of sheets, the package including a cover flap repeatedly moveable between an open position and a closed position, a pocket suitable for storing a plurality of sheets arranged in a stack, and a pressure-sensitive adhesive tape construction disposed on the cover flap such that closing the cover flap positions the exposed pressure-sensitive adhesive tape for contact with the exposed major surface of the first sheet, the pressure-sensitive adhesive tape construction including a) a plurality of adhesive tape structures that include a backing, a first pressure-sensitive adhesive composition disposed on a first surface of the backing, and a second adhesive composition disposed on a second surface of the backing, and b) a polymeric film disposed between the structures.

The package is convenient for storing and repeatedly dispensing individual oil absorbing porous polymeric sheets. Once the individual sheet is removed from the pocket in which it is stored, it is easily accessible by the user. The package also allows a sheet to be dispensed without the user touching the sheet prior to its removal from the pocket. The package is suitable for securely storing a single sheet or a number of sheets. The package can be constructed such that the opacity of the sheet to be dispensed is maintained in its original state until removed from the package by the user. The package is also portable and can be dimensioned to fit in small carrying cases including, e.g., shaving kits, duffel bags, backpacks, purses, and cosmetic bags.

Other features and advantages of the invention will be apparent from the following description of the preferred embodiments thereof, and from the claims.

DETAILED DESCRIPTION

Figure 1:
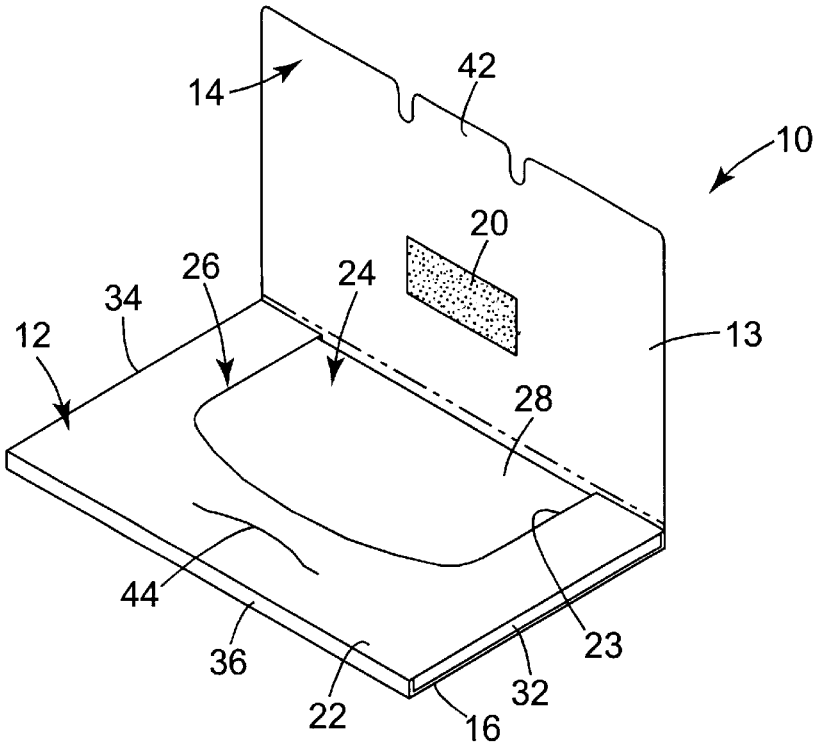
FIG. 1 is a perspective view of a package that includes a stack of sheets.
Figure 1A:
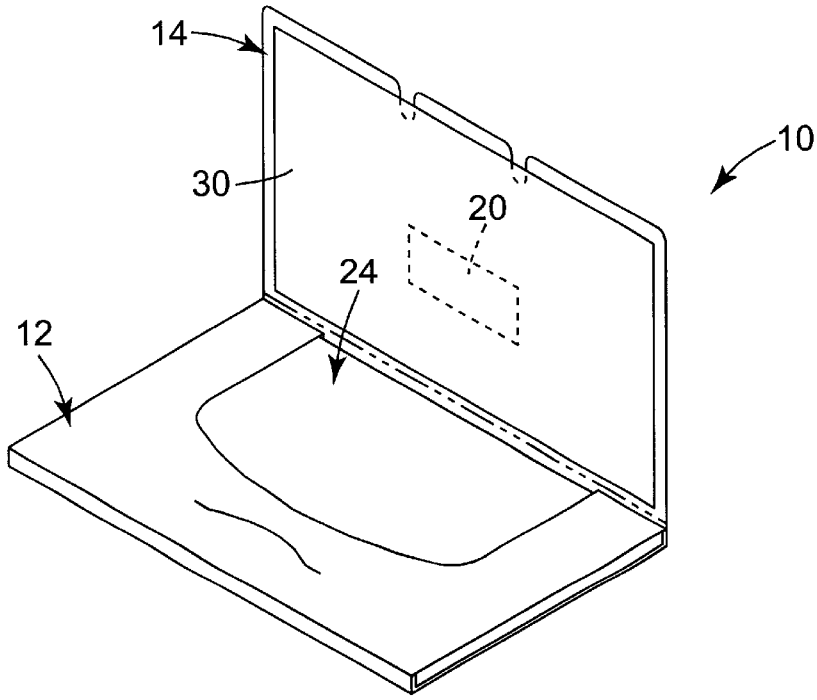
FIG. 1*a* is the package of FIG. 1 with a sheet bonded to the cover flap.

FIGS. 1–5 illustrate a package 10 for dispensing individual oil absorbing polymeric sheets from a stack of sheets. The package includes a pocket 12 and a hinged cover flap 14 extending from the bottom wall 16 of the pocket 12 and moveable between an open position and a closed position. A pressure-sensitive adhesive composition 20 is disposed on the inner surface 13 of the cover flap 14 and a plurality of sheets 18 arranged in a stack 24 are positioned in the pocket 12.

The pocket 12 includes a top wall 22 that is generally parallel to the bottom wall 16. The top wall 22 and the bottom wall 16 are generally movable relative to one another by application of pressure. The top wall 22 includes a continuous perimeter 23 that defines at least a portion of an opening 26 through which a major surface 28 of a first sheet 30 (i.e., the top sheet) of the stack of sheets 24 is exposed. Preferably the continuous perimeter 23 of the top wall 22 defines at least 50% of the opening 26 and may define 100% of the opening. The opening 26 is dimensioned to permit the exposed first sheet 30 to be lifted out of the pocket 12 so as to free the first sheet 30 from the pocket 12 and to expose the next sheet for subsequent dispensing. The dimension of the opening 26 will vary depending upon the properties of the sheet to be dispensed and the properties of the pressure-sensitive adhesive composition. Preferably the opening 26 is dimensioned to expose a major portion of the first sheet 30 and maintain an individual sheet securely in the pocket 12.

The pocket 12 also includes opposite side walls 32 and 34 that are generally parallel to each other, side wall 36, which is generally perpendicular to side walls 32 and 34, and side walls 38*a* and 38*b*, which are generally parallel to side wall 36 and perpendicular to side walls 32 and 34. Preferably the top wall 22 extends continuously along at least 50% of the perimeter of the bottom wall 16. The top wall 22, bottom wall 16 and side walls 32, 34, 36, 38*a* and 38*b* combine to form the pocket 12 and to retain the stack of sheets 20 including, e.g., a single sheet, in the package 10. Preferably the bottom wall 16 is rectangular in shape.

Figure 3:
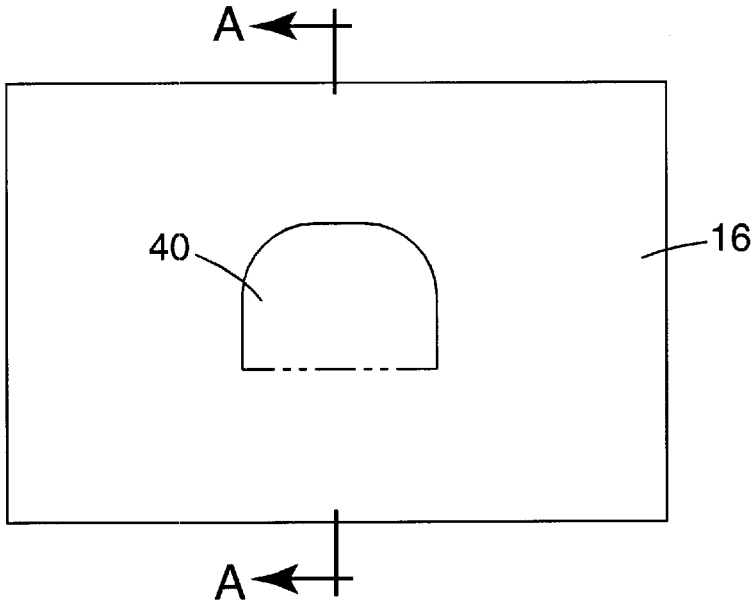
FIG. 3 is a bottom view of the package of FIG. 1.
Figure 4:
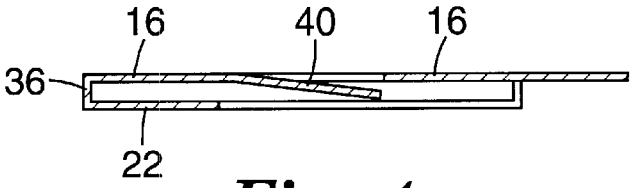
FIG. 4 is a view taken in cross section along line A—A of the package of FIG. 3 with the stack of sheets removed.
Figure 5:
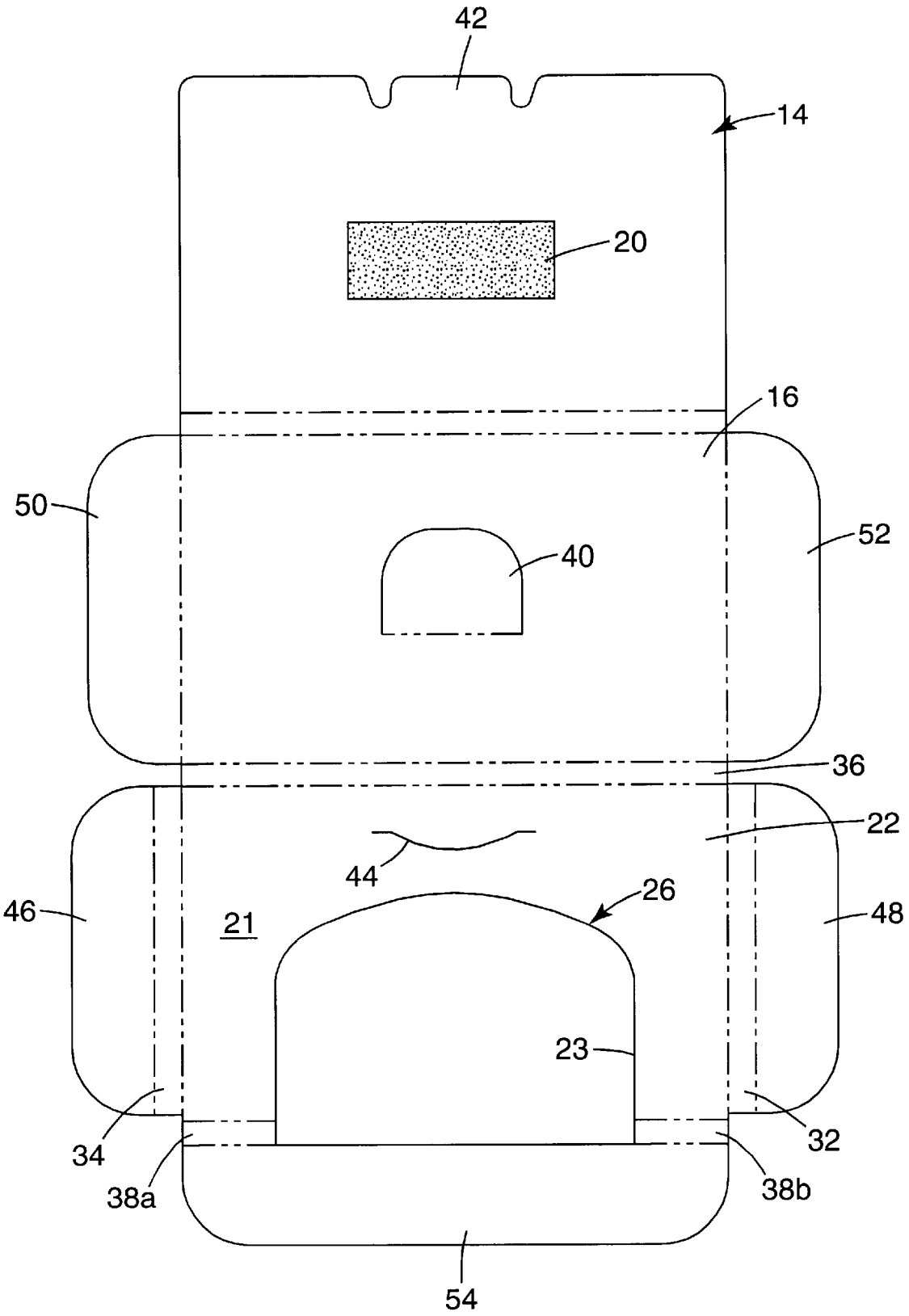
FIG. 5 is a plan view of an unassembled package.

The bottom wall 16 may include a hinged tab 40 capable of pivoting into the pocket 12, as shown in FIGS. 3–5. The hinged tab 40 can be pivoted in the direction of the opening 26 to apply additional force against the stack of stored sheets 24 and the pressure-sensitive adhesive composition 20.

The hinged cover flap 14 is moveable between an open position and a closed position such that it can be folded down onto the pocket 12. The cover flap 14 includes a tab 42 that can be engaged with a slot 44 on the top wall 22 of the pocket 12 and can be used as a mechanical-type closure.

FIG. 5 illustrates an unassembled package 10. A stack of sheets, not shown, can be placed on the inner surface 21 of the top wall 22 and over the opening 26. The top wall side flaps 46, 48 can be folded inward toward the opening 26 and over the stack of sheets to form side walls 32 and 34. The bottom wall side flaps 50, 52 can be folded inward toward the hinged tab 40. The folded top wall construction containing the stack of sheets can be folded onto the back wall 16. The leading flap 54 of the top wall 22 can be tucked under a portion of the bottom wall side flaps 50 and 52 so as to form side walls 38*a* and 38*b* and to secure the stack of sheets 24 in the pocket 12.

The stack of sheets 24 may include a number of oil absorbing polymeric sheets that are capable of absorbing skin oil, liquid (e.g., sweat), or a combination thereof. Examples of preferred oil absorbing polymeric sheets are described in U.S. Pat. No. 4,726,989, U.S. patent application Ser. No. 09/566,308 entitled, "BMF Face Oil Remover Film," filed on May 8, 1999, and PCT published application WO 99/29220, each of which is incorporated herein. These preferred oil absorbing sheets are capable of changing opacity when oil is absorbed indicating their effectiveness to the user.

Alternatively, the stack of sheets can include one or more sheets of a variety of materials. Examples of suitable sheets include non-woven webs and films. The sheets can include materials such as, e.g., polymers, cellulosic materials, or a combination thereof. The sheets can be porous, e.g., microporous, nonporous, or a combination thereof. The sheets can also be of a variety of colors and the colors may function as indicia, e.g., indicia of the presence of a compound on or in the sheet substrate, indicia as to the day of the week, or a combination thereof. The sheets may also have a variety of dimensions and shapes including, e.g., polygonal (e.g., hexagon, rectangle, square, diamond, or triangle), circular and elliptical.

The pressure-sensitive adhesive composition 20 disposed on the inner surface 13 of the cover flap 14 is dimensioned and positioned such that when the cover flap is in a closed position, the adhesive composition 20 is capable of contacting at least a portion of the major surface 28 of the sheet 30 that is exposed through the opening 26. Preferably the pressure-sensitive adhesive composition 20 is dimensioned and positioned on the cover flap 14 such that it contacts at least a portion of the central region of the first sheet 30. Pressure applied to the cover flap 14 at the pressure-sensitive adhesive composition 20 will cause the pressure-sensitive adhesive composition 20 to contact the exposed sheet 30 such that the exposed sheet 30 becomes bonded to the cover flap 14 through the pressure-sensitive adhesive composition 20. The package 10 is preferably compressible. The package 10 can be grasped between a user's fingers and thumb so as to pinch the cover 14, the stack of sheets 24 and the bottom wall 16 against each other, which, in turn, presses the pressure-sensitive adhesive composition against the exposed sheet 30 of the stack of sheets 24. When the cover flap 14 is then moved to an open position, the exposed sheet 30 remains bonded to the cover flap 14 such that it is lifted out of the pocket 12 and freed from the confines of the top wall 22. Upon removal of the exposed first sheet 30 from the pocket, a second sheet of the stack of sheets 24 becomes exposed through the opening 26.

The pressure-sensitive adhesive composition is formulated to exhibit sufficient tack to completely remove the first sheet from the pocket and then to allow the sheet to be removed (e.g., by a user) from the pressure-sensitive adhesive composition without tearing the sheet. The composition should also be formulated to allow the sheet to be cleanly removed from the adhesive composition such that no visible adhesive residue remains on the sheet.

The adhesive composition is preferably selected so as to maintain adhesion throughout repeated contact with the sheet to be dispensed. Preferably the pressure-sensitive adhesive composition remains tacky after repeated contact with a number of sheets, preferably after contact with at least 50 sheets, more preferably after contact with at least 60 sheets. Preferred pressure-sensitive adhesive compositions exhibit a 90° peel strength of no greater than about 300 g/25 mm, more preferably from about 25 g/25 mm to about 200 g/25 mm, most preferably from about 15 g/25 mm to about 150 g/25 mm, to the sheet to be dispensed as measured according to ASTM Test Method D3330 Method C, modified such that the sheet to be dispensed is pulled away from the adhesive tape sample. The adhesive tape sample is placed on the test panel such that the pressure-sensitive adhesive surface that is to contact the sheet to be dispensed faces upward, toward the sheet. The sheet to be dispensed is then placed on the pressure-sensitive adhesive tape surface and rolled down according to ASTM Test Method D3330. A peel speed of 300 mm/min is used to peel the sheet to be dispensed off of the adhesive tape.

Suitable pressure-sensitive adhesive compositions include acrylate-based pressure-sensitive adhesives, rubber pressure-sensitive adhesives including, e.g., natural rubber and synthetic rubber pressure-sensitive adhesives including, e.g., styrene-isoprene-styrene block copolymers and styrene-butadiene-styrene block copolymers, silicone-based pressure-sensitive adhesive compositions, polyurethane-based pressure-sensitive adhesive compositions, and combinations thereof.

The formulation of the pressure-sensitive adhesive composition may vary depending upon the sheet properties including, e.g., composition, texture, surface tension, stiffness and size of the sheet. Preferred pressure-sensitive adhesive compositions for use in dispensing an oil absorbing polymeric sheet are free of chemical species that tend to be absorbed by the oil absorbing sheet and alter the opacity of the sheet. Preferably the pressure-sensitive adhesive composition for use in dispensing oil absorbing polymeric sheets is an acrylate-based adhesive. Suitable acrylate-based pressure-sensitive adhesive tapes are available under the trade designation 3M Scotch Brand 4591HL double coated adhesive tape (3M Sumitomo, Japan).

Figure 11:
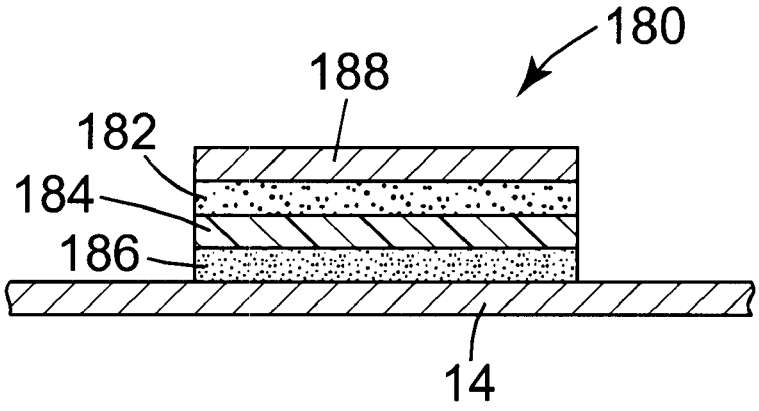
FIG. 11 is a side view of an adhesive tape disposed on a cover flap.
Figure 12:
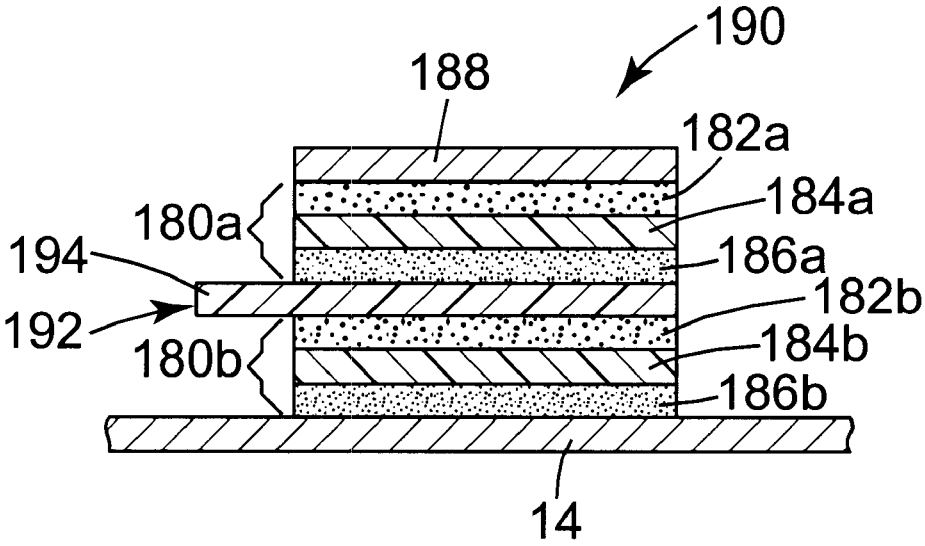
FIG. 12 is a side view of a multi-layer adhesive tape disposed on a cover flap.

The pressure-sensitive adhesive composition 20 is preferably in the form of a tape 180 that includes a layer of pressure-sensitive adhesive 182 disposed on a backing (e.g., polyester) 184, which is bonded to the cover flap 14 through a second adhesive composition 186, as shown in FIG. 11. The second adhesive composition 186 may be pressure-sensitive. The adhesive layers can be continuous or discontinuous. The tape 180 can include a release liner 188 disposed on the pressure-sensitive adhesive composition 182, which can be removed by the user to expose the pressure-sensitive adhesive composition 182. FIG. 12 illustrates a second adhesive tape construction 190 that includes multiple layers 180*a* and 180*b* of the adhesive tape construction of FIG. 11. The layers 180*a* and 180*b* of adhesive tape are separated by a liner 192 (e.g., a polymeric film, e.g., a polypropylene-polyethylene copolymer film) that includes a nontacky finger lift 194. A user can grasp the finger lift 194 and peel off the top adhesive tape structure 180*a* to expose a fresh layer of pressure-sensitive adhesive 182*b*.

Figure 2:
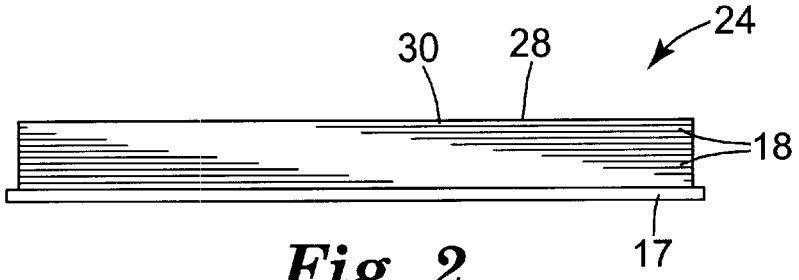
FIG. 2 is a side view of a plurality of sheets arranged in a stack and a rigid insert.

As shown in FIG. 2, the package 10 may also include an insert 17 positioned beneath the stack of sheets 24. The insert 17 is more rigid relative to the individual sheets or the stack of sheets 24. The insert 17 imparts stiffness to the stack of sheets 24 and helps to maintain the stack 24 in a relatively flat position in the pocket 12 during dispensing of the individual sheets 30. The insert 17 can be made from a variety of materials including, e.g., cardboard, plastic, e.g., a plastic sheet having a greater stiffness than the individual sheets of the stack, and metal.

Other embodiments are within the claims. For example, the package, in the closed position, or the bottom wall of the pocket, may also define a variety of shapes including, e.g., a polygon (e.g., hexagon, rectangle, square, diamond, or triangle), circle, and ellipse. The shape of the package may be similar or different relative to the shape of the stored sheet(s), such that numerous combinations of sheet shapes and package shapes are available. One example of such a combination is a square package that includes circular sheets. Another example includes a circular package having sheets that are hexagonal-, square- or diamond-shaped.

Figure 6:
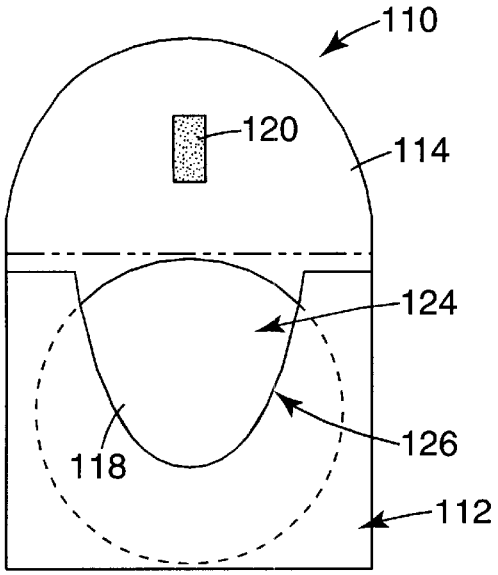
FIG. 6 is a plan view of a package that includes a stack of sheets according to a second embodiment.

FIG. 6 illustrates an embodiment of the package 110 that includes a pocket 112, a cover flap 114, a pressure-sensitive adhesive composition 120 disposed on the cover flap 114, and a stack of sheets 124 stored in the pocket 112 and exposed through the opening 126. The sheets 118 are circular in shape and the pocket 112 is square in shape.

Figure 7:
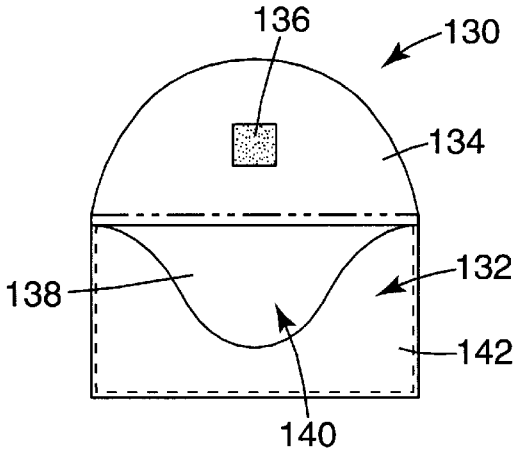
FIG. 7 is a plan view of a package that includes a stack of sheets according to a third embodiment.

FIG. 7 shows an embodiment in which the package 130 that is in the form of an envelope that includes a pocket 132, a cover flap 134 and a pressure-sensitive adhesive composition 136 disposed on the cover flap 134. The top wall 142 of the pocket 132 extends from the back wall and is generally parallel to the back wall. A major surface of a rectangular shaped sheet 138 is exposed through opening 140, which is partially defined by the top wall 142.

Figure 8:
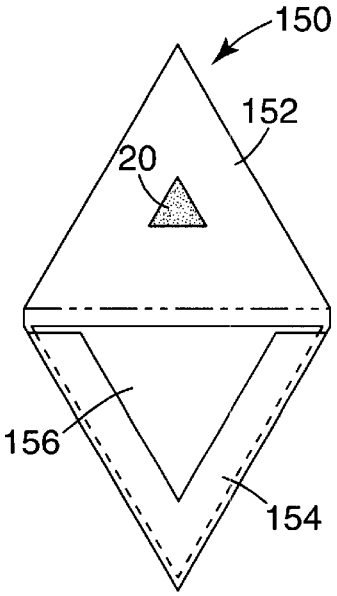
FIG. 8 is a plan view of a package that includes a stack of sheets according to a fourth embodiment.

FIG. 8 depicts a package 150 that is generally triangular in shape when the cover flap 152 is in a closed position over the pocket 154. The stack of sheets 156 disposed in the pocket 154 is also generally triangular in shape.

Figure 9:
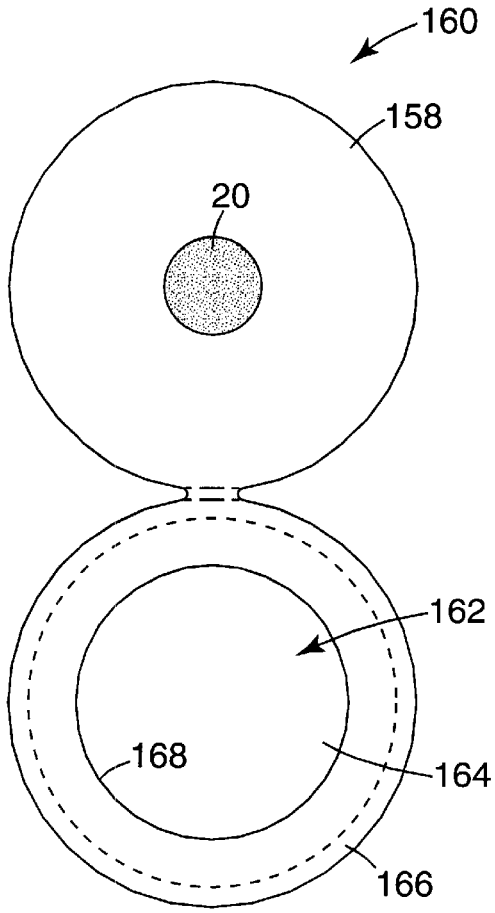
FIG. 9 is a plan view of a package that includes a stack of sheets according to a fifth embodiment.

FIG. 9 illustrates a circular embodiment of a package 160 that includes a circular opening 162 defined by a perimeter 168 of the top wall 166 of the pocket and circular sheet 164 exposed through opening 162. A pressure-sensitive adhesive composition 20 is disposed on the hinged cover flap 158.

Figure 10:
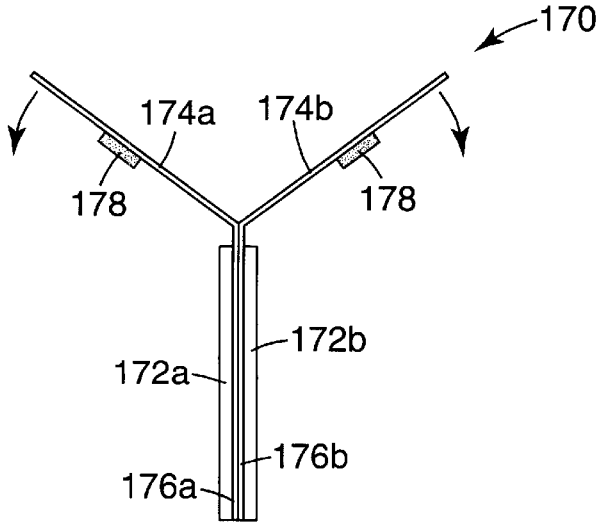
FIG. 10 is a side view of a package according to a sixth embodiment.

FIG. 10 illustrates a package 170 that includes two pockets 172*a* and 172*b*, two hinged cover flaps 174*a* and 174*b* and a pressure-sensitive adhesive composition 178 disposed on the inner surface of the cover flaps 174*a* and 174*b*. The back walls 176*a* and 176*b* of pockets 172*a* and 172*b* are bonded together. Alternatively, the pockets 172*a* and 172*b* may share a common back wall.

All patents and patent applications cited in this document, including those cited in the Background, are incorporated by reference in total.

What is claimed is:

1. A package for dispensing individual oil absorbing polymeric sheets from a stack of said sheets, said package comprising:

(a) a flat cover flap repeatedly moveable between an open position and a closed position;

(b) a pocket comprising a bottom wall, a top wall generally parallel to said bottom wall, and at least one side wall disposed between and perpendicular to said top wall and said bottom wall;

(c) a plurality of oil absorbing polymeric sheets arranged in a stack and positioned in said pocket; and (d) a pressure-sensitive adhesive composition disposed on said cover flap such that closing said cover flap positions said pressure-sensitive adhesive composition for direct contact with a major surface of a first sheet of said stack of sheets.

2. The package of claim 1, wherein said pressure-sensitive adhesive composition level of adhesion to said polymeric sheets is such that when pressed against the first sheet, the adhesive bonds the first sheet to said cover flap through said pressure-sensitive adhesive composition so that moving said cover flap to an open position frees the first sheet from said pocket.

3. The package of claim 1, wherein said bottom wall further comprises a depressibe hinged tab.

4. The package of claim 1 further comprising a rigid insert disposed in said pocket.

5. The package of claim 1, wherein said adhesive composition is in the form of an adhesive tape construction comprising a plurality of pressure-sensitive adhesive layers.

6. The package of claim 1, wherein said pressure-sensitive adhesive composition is in the form of an adhesive tape construction comprising:

a) a plurality of adhesive tape structures comprising
   1) a backing;
   2) a first pressure-sensitive adhesive composition disposed on a first surface of the backing; and
   3) a second adhesive composition disposed on a second surface of said backing; and b) a polymeric film disposed between said structures and being removable from at least one of said structures.

7. The package of claim 1, wherein said pressure-sensitive adhesive composition comprises an acrylate.

8. The package of claim 1, wherein said pressure-sensitive adhesive composition is positioned on said cover flap to contact at least a portion of a center region of the first sheet.

9. The package of claim 1 further comprising a second pocket.

10. The package of claim 1, wherein said pocket comprises a bottom wall and a top wall extending from said bottom wall.

11. A package for dispensing individual sheets from a plurality of sheets arranged in a stack, said package comprising:

(a) a cover flap moveable between an open position and a closed position;

(b) a pocket containing a plurality of oil absorbent polymeric sheets arranged in a stack, said pocket comprising:
   (1) a top wall defining an opening through which a major surface of a first sheet of stored stack of sheets is exposed, and
   (2) a bottom wall comprising a depressible hinged tab wherein the depressible hinged tab is pivotable in the direction of the opening; and (c) a pressure-sensitive adhesive composition disposed on a surface of said cover flap such that closing said cover flap positions said pressure-sensitive adhesive composition for contact with the exposed major surface of the first sheet;

wherein the hinged tab is pivotable and positioned to apply additional force against the stack of sheets into the pressure-sensitive adhesive composition when force is applied to the hinged tab.

12. The package of claim 11, wherein said pressure-sensitive adhesive composition level of adhesion to said polymeric sheets is such that when pressed against the first sheet, the adhesive bonds the first sheet to said cover flap through said pressure-sensitive adhesive composition so that moving said cover flap to an open position frees the first sheet from said pocket.

13. The package of claim 11, further comprising a plurality of sheets arranged in a stack.

14. The package of claim 11 further comprising a second pocket.

15. The package of claim 11 further comprising a rigid insert disposed in said pocket.

16. The package of claim 11, wherein said adhesive composition is in the form of an adhesive tape construction comprising a plurality of pressure-sensitive adhesive layers.

17. The package of claim 11, wherein said pressure-sensitive adhesive composition is in the form of an adhesive tape construction comprising:

a) a plurality of adhesive tape structures comprising
   1) a backing;
   2) a first pressure-sensitive adhesive composition disposed on a first surface of the backing; and
   3) a second adhesive composition disposed on a second surface of said backing; and b) a polymeric film disposed between said structures and being removable from at least one of said structures.

18. The package of claim 11, wherein said pressure-sensitive adhesive composition is selected from the group consisting of acrylate-, rubber-, polyurethane- and silicone-based pressure-sensitive adhesive compositions, and combinations thereof.

19. The package of claim 11, wherein said pressure-sensitive adhesive composition is positioned on said cover flap to contact at least a portion of a center region of the first sheet.

20. A disposable package for dispensing individual sheets from a plurality of sheets arranged in a stack, said package comprising:

(a) a cover flap repeatedly moveable between an open position and a closed position;

(b) a pocket containing a plurality of oil absorbing polymeric sheets arranged in a stack, said pocket comprising:

(1) a bottom wall, and (2) a top wall generally parallel to said bottom wall and having a continuous perimeter that defines at least 50% of an opening through which a major surface of a first sheet of a stored stack of sheets is exposed wherein the package is formed at least in part of a folded blank; and (c) a pressure-sensitive adhesive composition disposed on a surface of said cover flap such that closing said cover flap positions said pressure-sensitive adhesive composition for contact with the exposed major surface of the first sheet wherein the package is compressible upon application of hand pressure by a user.

21. The package of claim 20, wherein said pressure-sensitive adhesive composition level of adhesion to said polymeric sheets is such that when pressed against the first sheet, the adhesive bonds the first sheet to said cover flap through said pressure-sensitive adhesive composition so that moving said cover flap to an open position frees the first sheet from said pocket.

22. The package of claim 20, further comprising a plurality of sheets arranged in a stack.

23. The package of claim 20, wherein said bottom wall comprises a depressible hinged tab.

24. The package of claim 20, further comprising a second pocket.

25. The package of claim 20, wherein said adhesive composition is in the form of an adhesive tape construction comprising a plurality of pressure-sensitive adhesive layers.

26. The package of claim 20, wherein said pressure-sensitive adhesive composition is in the form of an adhesive tape construction comprising:

a) a plurality of adhesive tape structures comprising 1) a backing;

2) a first pressure-sensitive adhesive composition disposed on a first surface of the backing; and 3) a second adhesive composition disposed on a second surface of said backing; and b) a polymeric film disposed between said structures and being removable from at least one of said structures.

27. The package of claim 20, wherein herein said pressure-sensitive adhesive composition is selected from the group consisting of acrylate-, rubber-, polyurethane- and silicone-based pressure-sensitive adhesive compositions, and combinations thereof.

28. A package for dispensing individual sheets from a stack of sheets, said package comprising:

(a) a cover flap repeatedly moveable between an open position and a closed position;

(b) a pocket suitable for storing a plurality of sheets arranged in a stack; and (c) a pressure-sensitive adhesive tape construction disposed on said cover flap such that closing said cover flap positions the exposed pressure-sensitive adhesive tape for contact with the exposed major surface of the first sheet, said pressure-sensitive adhesive tape construction comprising (a) a plurality of adhesive tape structures comprising (1) a backing;

(2) a first pressure-sensitive adhesive composition disposed on a first surface of the backing; and (3) a second adhesive composition disposed on a second surface of said backing; and (b) a polymeric film disposed between said structures.

* * * * *